US006293649B1

(12) United States Patent
Norton

(10) Patent No.: US 6,293,649 B1
(45) Date of Patent: Sep. 25, 2001

(54) PRINT CARTRIDGE LATCHING MECHANISM FOR A DISPLACEABLE PRINT CARTRIDGE CHUTE

(75) Inventor: Kirkpatrick W Norton, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/303,256

(22) Filed: Apr. 30, 1999

(51) Int. Cl.[7] ..... B41J 23/00; B41J 2/175

(52) U.S. Cl. ..... 347/37; 347/86

(58) Field of Search ..... 347/37, 108, 87, 347/38, 32, 86, 50, 49, 85, 68; 400/84, 88, 54, 391, 691

(56) References Cited

U.S. PATENT DOCUMENTS

| | | | | |
|---|---|---|---|---|
| 4,907,018 | * | 3/1990 | Pinkerpell et al. | 347/37 |
| 5,020,926 | * | 6/1991 | Wilhelm | 400/54 |
| 5,408,746 | | 4/1995 | Thoman et al. | 347/19 |
| 5,617,128 | | 4/1997 | Thoman et al. | 347/37 |
| 5,646,665 | | 7/1997 | Swanson et al. | 347/33 |
| 5,712,669 | | 1/1998 | Swanson et al. | 347/19 |
| 5,870,125 | | 2/1999 | Swanson et al. | 347/30 |
| 6,065,831 | * | 5/2000 | Kawaura et al. | 347/108 |

* cited by examiner

*Primary Examiner*—John Barlow
*Assistant Examiner*—Charles W. Stewart, Jr.
(74) *Attorney, Agent, or Firm*—Robert C. Sismilich

(57) ABSTRACT

A print cartridge latching mechanism for a displaceable print cartridge chute used in an inkjet printer. The chute holding the print cartridges is displaceable from the carriage that sweeps the cartridges relative to the media during printing. The chute can be moved from a printing position engaged with the carriage to a service position adjacent a side of the printer so as to facilitate installation and removal of the cartridges through the side rather than the top of the printer. The print cartridge latching mechanism is operable through an access opening in the side of the printer. The mechanism latches the chute to the carriage, aligns the print cartridges in proper position for printing, and maintains sufficient force to ensure good electrical connection between the printer control electronics and the printhead.

21 Claims, 9 Drawing Sheets

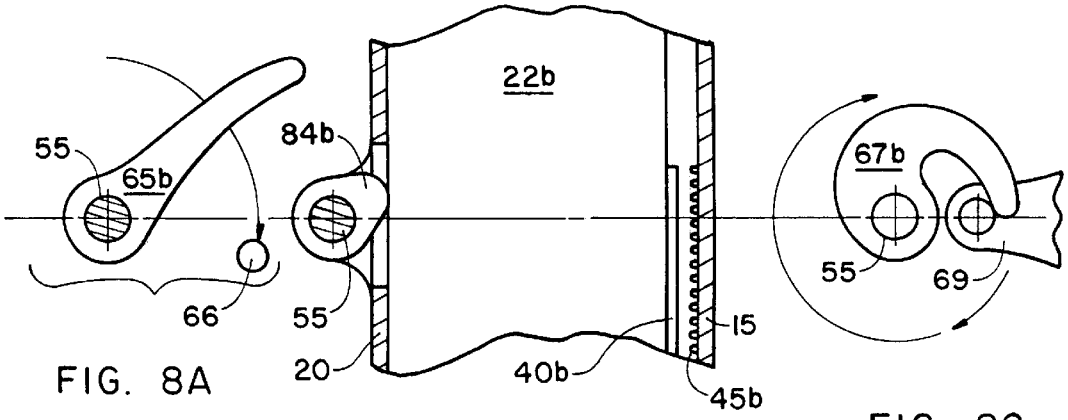
FIG. 8A
FIG. 8B
FIG. 8C
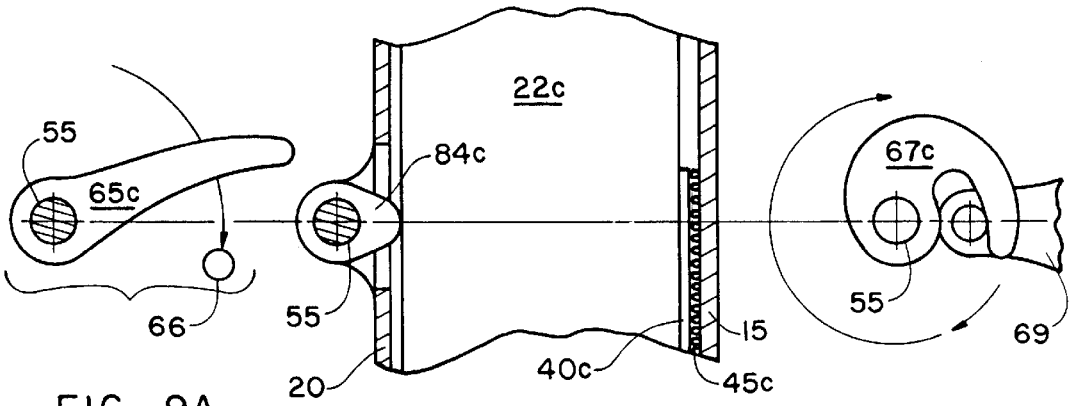
FIG. 9A
FIG. 9B
FIG. 9C
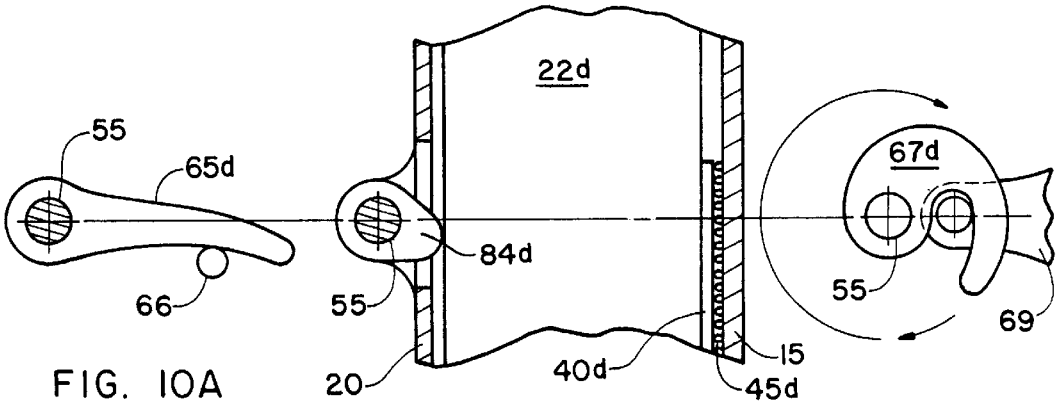
FIG. 10A
FIG. 10B
FIG. 10C

PRINT CARTRIDGE LATCHING MECHANISM FOR A DISPLACEABLE PRINT CARTRIDGE CHUTE

CROSS-REFERENCE TO RELATED APPLICATIONS

This application relates to the subject matter disclosed in the application Ser. No. 09/033,257, filed concurrently herewith, entitled "Displaceable Print Cartridge Chute".

FIELD OF THE INVENTION

The present invention relates generally to inkjet printers. It relates more particularly to the mounting and electrical connection of thermal inkjet print cartridges in the printer.

BACKGROUND OF THE INVENTION

Inkjet printers, and thermal inkjet printers in particular, have come into widespread use in businesses and homes because of their low cost, high print quality, and color printing capability. The operation of such printers is relatively straightforward. In this regard, drops of a colored ink are emitted onto the print media during a printing operation, in response to commands electronically transmitted to the printhead. These drops of ink combine on the print media to form the text and images. Inkjet printers may use a number of different ink colors. One or more printheads may be contained in a print cartridge, which may either contain the supply of ink for each printhead or be connected to an ink supply located off-cartridge. An inkjet printer frequently can accommodate two to four print cartridges. The cartridges typically are mounted side by side in a chute attached to a carriage which sweeps the cartridges back and forth within the printer during printing.

While inkjet printers have achieved a high level of reliability, there are times when the cartridges containing the printhead must be accessed by the owner or user of the printer. If the cartridge contains the ink supply for the printhead, it must be removed for replacement or refill when the supply runs out. Even if the ink supply is off-cartridge, the printheads may occasionally clog and need manual cleaning.

Print cartridges have typically required access from a top portion of the printer. In some printers, most if not all inkjet cartridges are positioned within the printer at some distance from any one of the wall members, thus making access from a wall side of the printer impractical. Even if the back and forth movement of the cartridges during printing brings them near to a side of the printer, access to all but the cartridge nearmost the side wall member is not feasible. In other inkjet printers, a latching lever which holds the print cartridge in place must be flipped up from the top to remove the cartridges. In yet other inkjet printers, keying features which ensure that different color cartridges are installed in the correct chute stalls require a substantially vertical insertion of the cartridge during installation. The need for top access increases as the height of the print cartridge approaches the height of the printer, as can occur when cartridges become taller to hold more ink, or printer heights are reduced to conserve space.

While access to install and remove cartridges from a top portion of the printer has been generally satisfactory for most office and home environments, with the introduction of internet appliances such access is not generally satisfactory. More particularly, internet appliances such as cable boxes, DVD players, and other such electronic components must generally be stackable. Thus, it would be impractical to position a top access printer in such a stacked arrangement.

Accordingly, it would be highly desirable to have a new and improved inkjet printer that could be stacked with other electronic devices and that would provide access to replace depleted inkjet cartridges in an easy and convenient manner.

SUMMARY OF THE INVENTION

In a preferred embodiment, the present invention may be implemented as a print cartridge latching mechanism for a displaceable chute that allows print cartridges to be accessed through a side of the printer rather than through the top of the printer. A printer constructed in accordance with the present invention can be stacked with other equipment and still provide access to the print cartridges without the need to remove equipment on top of the printer.

Such a printer has a chute with walls defining one or more receiving spaces or stalls into which print cartridges may be installed. The chute is attached to a carriage which moves the cartridges along an axis and relative to the print media during a printing operation. The chute and carriage are connected by a mechanism which allows the chute to be located in a proper position for printing on the media, and in a different position for servicing the print cartridges, such as installing or removing them. A latching mechanism on the chute engages the carriage to hold the chute in the printing position, and disengages from the carriage to allow the chute to move to the service position. The latching mechanism has a shaft, a cam latch that engages the carriage, and a handle that opens and closes the latch and moves the chute. Preferably, the shaft also has a preload cam attached to it for each stall into which a cartridge may be installed.

Each print cartridge has a set of printhead electrical interconnects which receive signals that control the flow of ink; these interconnects mate with a set of controller interconnects mounted on the carriage that are attached to the drive electronics which signal the printhead to emit ink. A first opening in the chute where the printhead electrical interconnects are located allows the two sets of interconnects to be maintained in electrical contact during printing by a biasing force applied by the preload cam. The preload cam applies this force by contacting the print cartridge at a position spaced apart from the first opening at the opposite end of the stall.

In operation, the latching mechanism engages the carriage before the preload cams start exerting biasing force on the cartridges. The latching mechanism is rotatable until just past the point of maximum biasing force, where a stop or the geometry of the cam latch prevents further motion. A guide arrangement in the receiving space cooperates with datums on the print cartridge to direct the cartridge into proper mechanical and electrical alignment when the biasing force is applied.

Other aspects and advantages of the present invention will become apparent from the following detailed description, taken in conjunction with the accompanying drawings, illustrating by way of example the principles of the invention.

BRIEF DESCRIPTION OF THE DRAWINGS

FIGS. 8A–8C show the latching mechanism of FIG. 6 in a first intermediate position in which the cam latch starts to engage the pin, using the same three views of FIG. 7.

FIGS. 9A–9C show the latching mechanism of FIG. 6 in a second intermediate position in which the preload cam exerts maximum biasing force on the cartridge, using the same three views of FIG. 7.

FIGS. 10A–10C show the latching mechanism of FIG. 6 in the closed position where the handle is restrained by the stop pin, using the same three views of FIG. 7.

DESCRIPTION OF THE PREFERRED EMBODIMENT

Figure 1A:
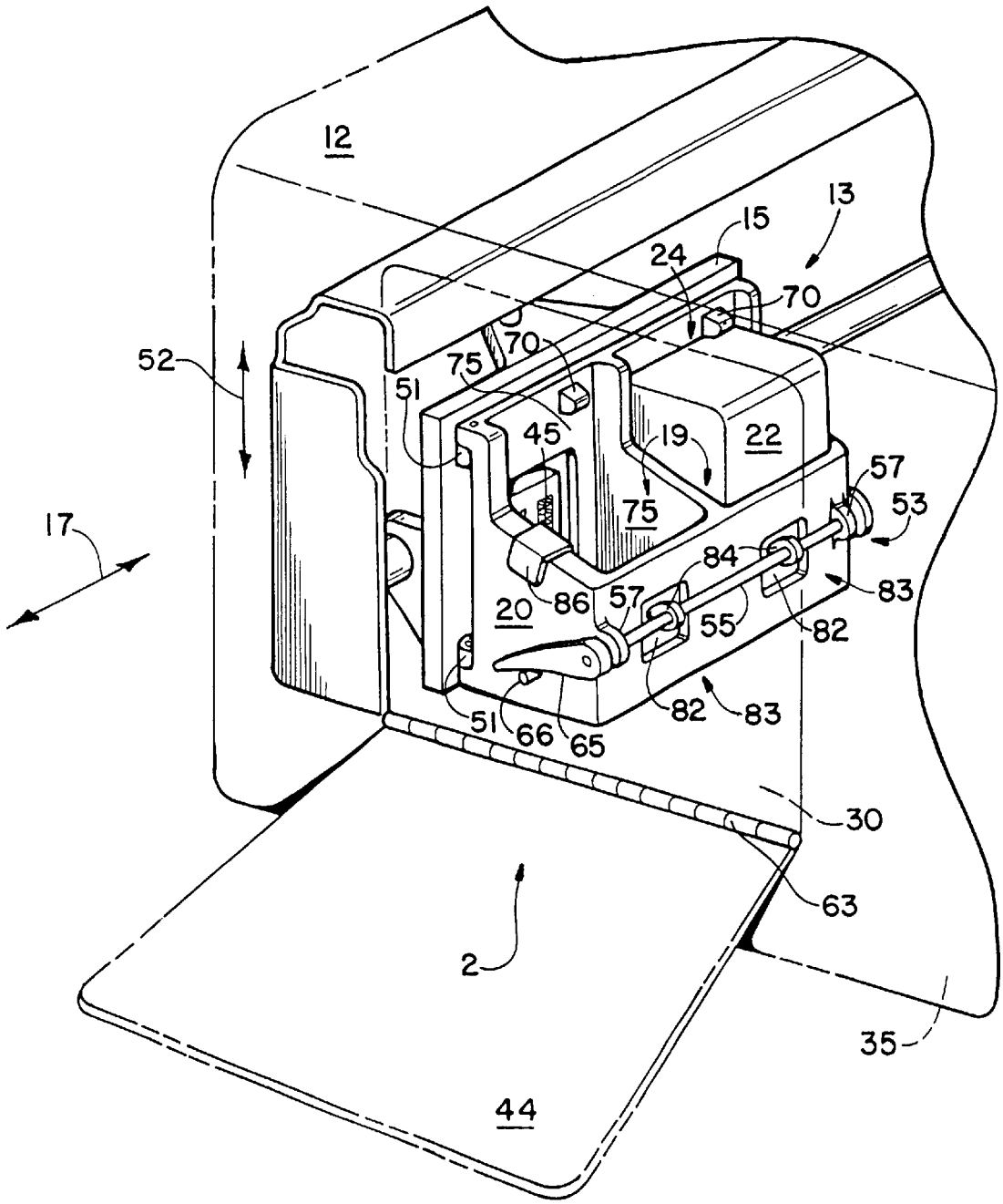
FIGS. 1A–1B are perspective views of a rotationally displaceable print cartridge chute embodying the print cartridge latching mechanism of the present invention, the chute shown in a printing position in FIG. 1A and a service position in FIG. 1B; a print cartridge is shown installed in one of the two stalls illustrated.
Figure 1B:
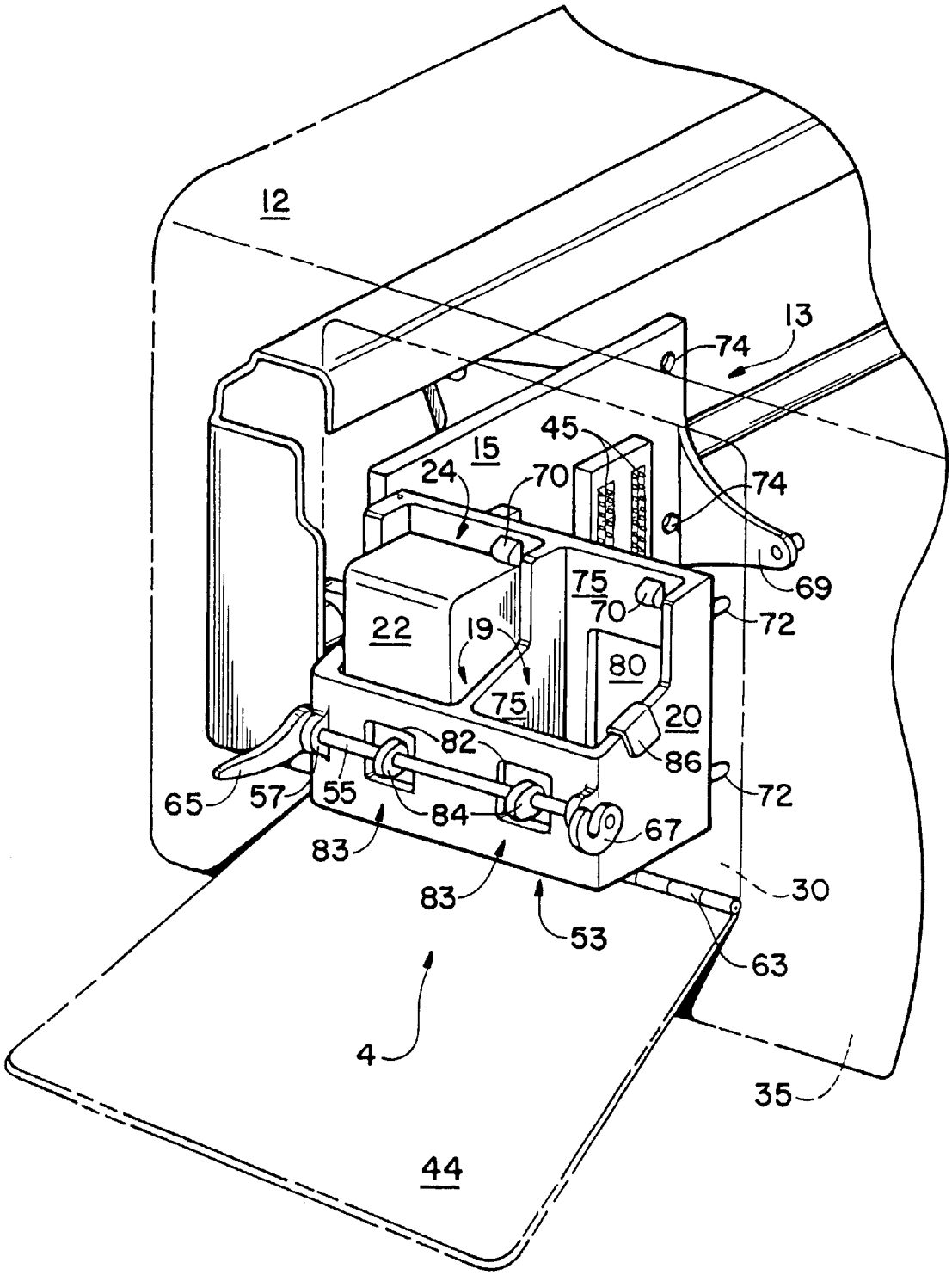
Figure 2:
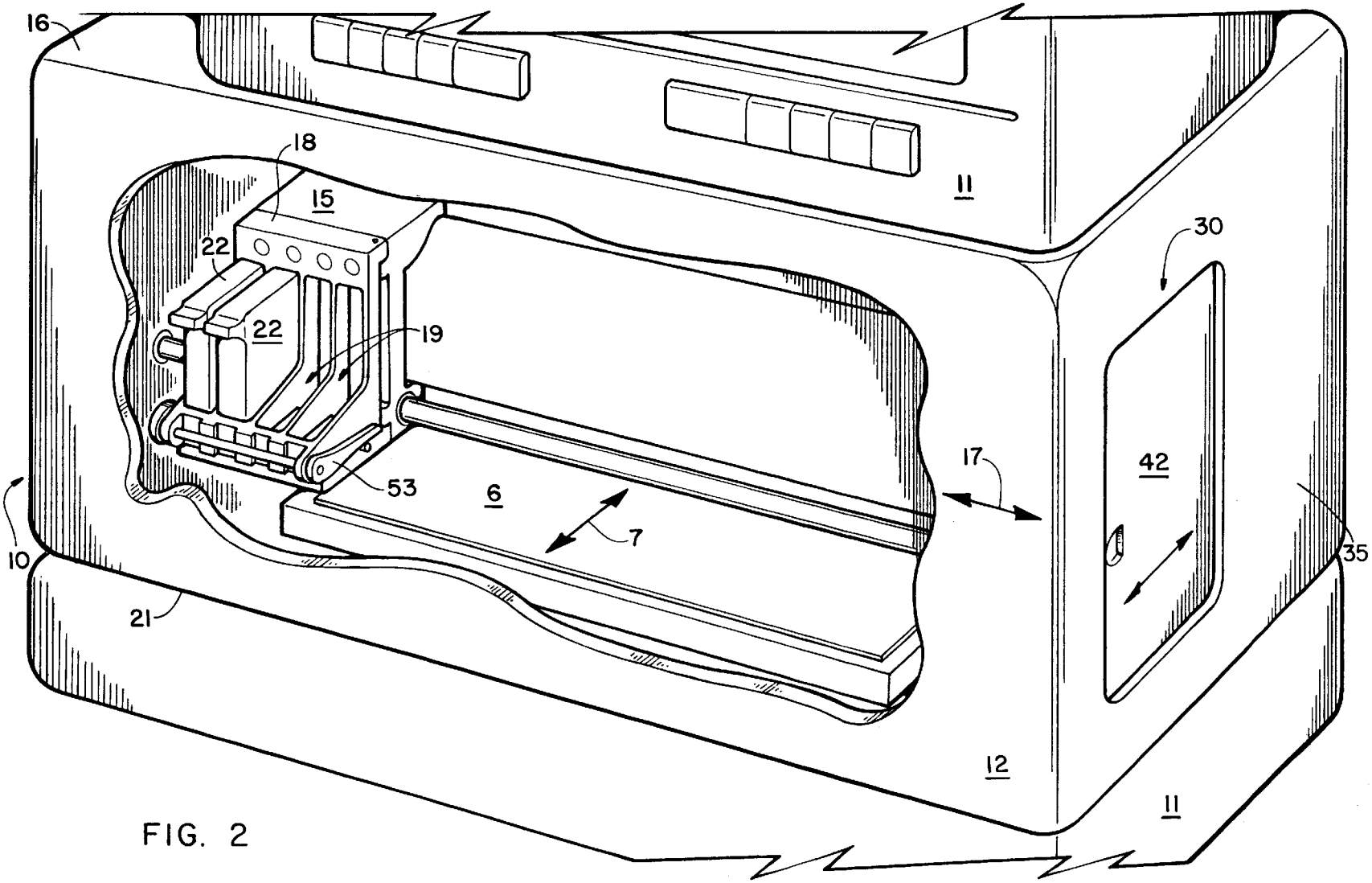
FIG. 2 is a perspective view of a printer embodying the present invention.

Referring now to the drawings, and more particularly to FIGS. 1A, 1B and 2, there is illustrated a printer 10 which is constructed in accordance with the present invention. The printer 10 includes an enclosure 12 that is adapted to be stacked with other electronic components in a home entertainment center. In this regard, the enclosure 12 has an esthetically pleasing ornamental design that fits well with other electrical equipment 11, such as DVD players, cable boxes, and the like.

In order to facilitate ejecting ink droplets onto a print medium sheet 6, the printer 10 generally includes a print mechanism 13 that comprises a carriage unit 15 and associated drive electronics 48 that will be described hereinafter in greater detail. The carriage unit 15 is mounted for rectilinear movement along a slider bar 14 secured within the enclosure 12. A cartridge chute 20 having one or more stalls, such as a stall 19, is mounted for movement relative to the carriage unit 15. Such relative movement is an important feature of the present invention in order to facilitate ease in installing and removing a print cartridge 22 removably mounted on the stall 19.

The print mechanism 13 also includes a latching mechanism indicated generally at 53 mounted to the chute 20. The latching mechanism 53 generally includes a cam latch 67 connected via a shaft 55 to an actuating handle 65 that is movable between a closed position (FIG. 1A) and an opened position (FIG. 1B) by a user moving the actuating handle 65 between closed and opened positions. This is another important feature of the present invention in order to release the chute 20 from carriage 15 and to facilitate the movement of the chute 20 relative to the carriage 15 by the user grasping the handle 65 and pulling it outwardly. The latching mechanism 53 also facilitates latching the print cartridge 22 within the chute 20 in mating engagement with the drive electronics 48 as will be described. In this regard, after a depleted print cartridge 22 has been removed from the chute 20 and replaced with a new cartridge 22, the user grasps the handle 65 and pushes it inwardly to cause the chute 20 to move into a latchable position relative to the carriage 15. Once the chute 20 is moved to the latchable position, the user rotates the handle 65 that causes the print cartridge 22 to be mechanically and electrically secured to the drive electronics 48 while simultaneously causing the chute 20 to be removably attached to the carriage 15 in a printing position 2 (FIG. 1A).

In order to facilitate user access to the chute 20 and the print cartridge 22 disposed therein, the enclosure 12 includes a top planar surface 16, a bottom planar surface 21, and a plurality of vertical wall members or sides, where one of the wall members 35 has an access opening 30. The access opening 30 has a sufficient height and width to permit a user to have easy access to the handle 65. In this manner, the user can rotate the handle 65 into either the closed position or the open position for securing or releasing the chute 20 from the carriage unit 15 and for securing or releasing the print cartridge 22 from its mechanical and electrical engagement with the drive electronics 48.

Moreover, the user can also push and pull the handle 65 to move the chute 20 relative to the carriage 15 to facilitate either installing or removing print cartridges 22 from the chute 20 or to facilitate positioning the chute 20 in the latchable position as described earlier.

Figure 3B:
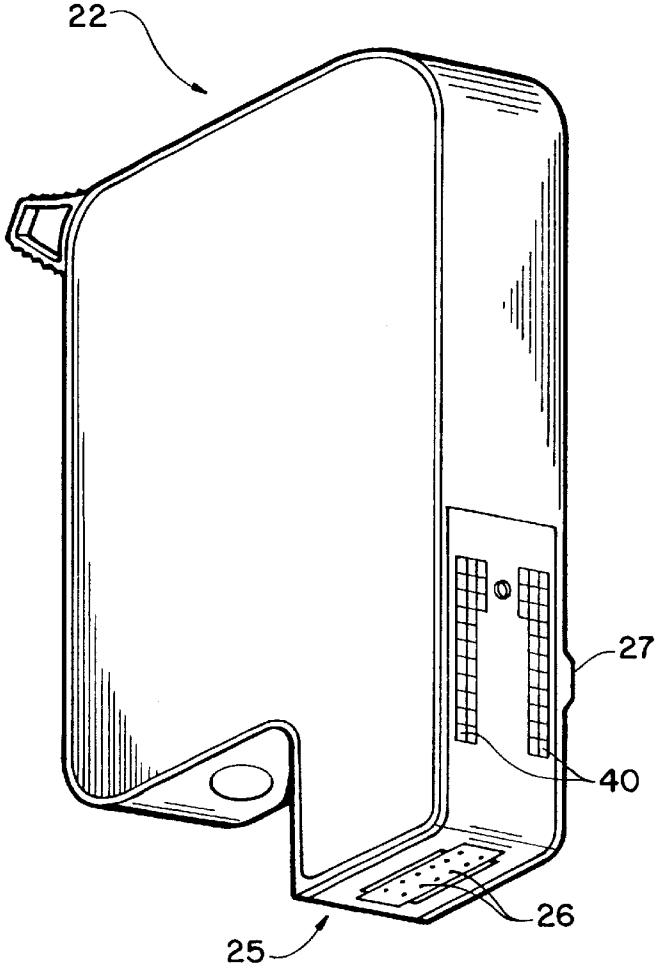
FIG. 3B PRIOR ART
FIGS. 3A–3B are perspective views of a prior art print cartridge usable in a printer embodying the present invention.
Figure 3A:
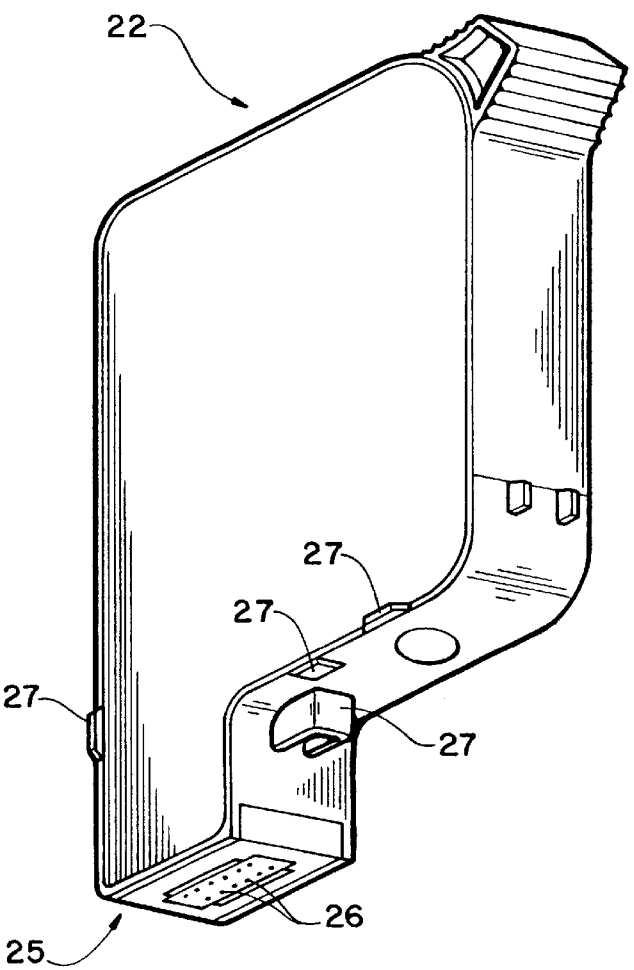
FIG. 3A PRIOR ART

Before discussing the apparatus embodying the present invention in further detail, it may be beneficial to briefly review the elements of a prior art print cartridge usable with the present invention. An exemplary mechanical configuration of the cartridge 22 is shown in FIG. 3. The cartridge 22 contains a thermal inkjet printhead 25 located at the bottom of the cartridge. The printhead 25 is well known in the art, and includes a plurality of print nozzles 26 disposed in a printhead plane that is generally parallel to the print media sheet 6. In this exemplary embodiment the nozzles 26 eject ink droplets in a direction generally orthogonal to the printhead plane. As will be discussed hereinafter, the cartridge 22 is also provided with printhead interconnects 40 to electrically connect the printhead 25 to the drive electronics 48 to control the ejection of ink from the printhead 25. Datums 27 located on the surface of the cartridge 22 cooperate with a guide arrangement on the chute 20 or carriage 15 to properly align the cartridge 22 in the chute 20 so that printhead interconnects 40 align with and forcibly contact mating controller interconnects 45 associated with each stall 19 as best shown in FIG. 1B which are in electrical communication with the print controller electronics 49. The datums 27 and the guide arrangement also align the printhead 25 relative to the print media 6. Exemplary configurations of cartridge datums and guide arrangements usable with the present invention are described in U.S. Pat. No. 5,408,746, "Datum Formation for Improved Alignment of Multiple Nozzle Members in a Printer", by Thoman et al., and in U.S. Pat. No. 5,646,665, "Side Biased Datum Scheme for Inkjet Cartridge and Carriage", by Swanson et al., both of which are assigned to the assignee of the present invention and are also hereby incorporated by reference. The shape and dimensions of the cartridge 22 and its elements can vary from that shown in FIG. 3, and thus the shape and dimensions described herein are illustrative only and are not meant to limit the present invention.

Considering now the chute 20 in greater detail with reference to FIGS. 1A and 1B, the chute 20 is attached to the carriage 15 by an attachment arrangement having a pivoting mechanism 51 that enables all print cartridges 22 to be accessed through the vertical wall 35 containing the access opening 30. The pivoting mechanism 51 permits the chute 20 to pivot to position the one or more cartridges 22 adjacent the opening 30 when the chute 20 is in the service position 4, as shown in FIG. 4B. The pivoting mechanism 51 is connected to the end of the carriage 15 nearest to the access opening 30. The axis 52 of the pivoting mechanism 51 is generally orthogonal to the carriage axis 17.

In the preferred embodiment the pivoting mechanism 51 is implemented as two hinges providing pivoting of the chute 20 about a common axis 52. However, the invention does not limit the pivoting mechanism 51 to one or more hinges; any pivoting mechanism known to those skilled in the art, such as a sliding guide or a multiple bar linkage, may be substituted for the hinge arrangement.

Figure 4A:
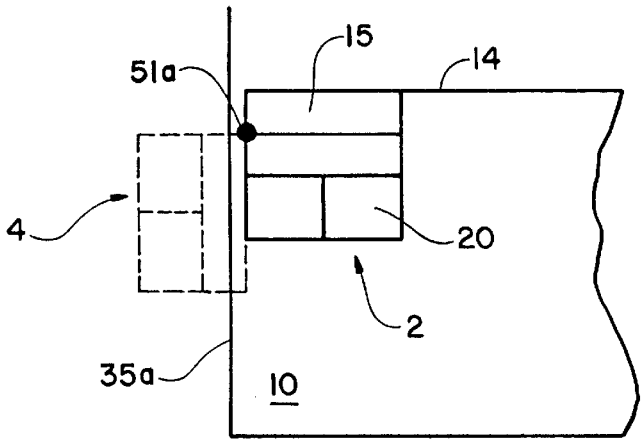
FIGS. 4A–4C are simplified top views of printers embodying the present invention showing differing displacements of a rotationally displaceable print cartridge chute from to the carriage; printing positions are shown in solid and service positions are shown in phantom.
Figure 4B:
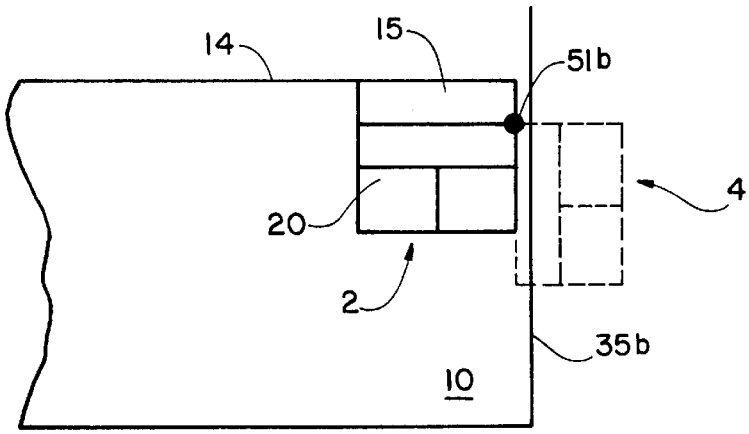
Figure 4C:
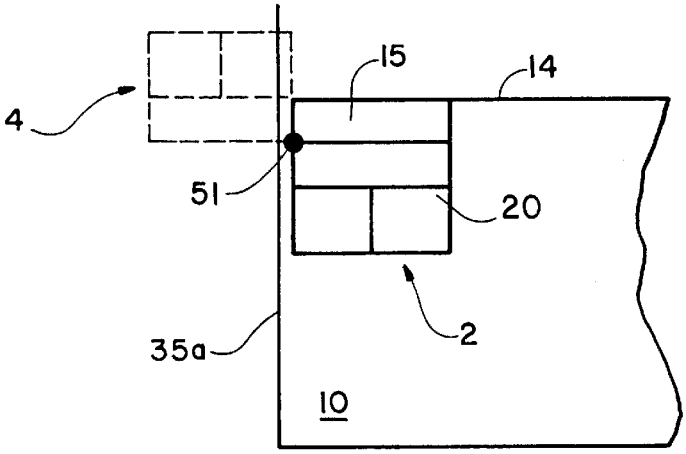

As best seen in the simplified top views of FIGS. 4A and 4B, the side 35 through which access is provided can be located adjacent either end of the slider bar 14. FIG. 4A shows the service position 4 at the left side 35 of the printer 10, with the pivoting mechanism 51*a* located at left ends of the chute 20 and carriage 15. FIG. 4B shows the service position 4 at the right side 35*b* of the printer 10, with the pivoting mechanism 51*b* located at right ends of the chute 20 and carriage 15. The chute 20 can be pivoted to a service position 4 approximately 90 degrees displaced from the carriage 15 (FIGS. 4A and 4B), or to a service position 4 approximately 180 degrees displaced from the carriage 15 (FIG. 4C).

To align the chute 20 with the carriage 15, the chute 20 includes at least one first mating member, each first mating member engaging with a corresponding second mating member located on the carriage 15. When the first and second mating members are engaged, the chute 20 is maintained in proper alignment for the printing position 2. In the preferred embodiment as best shown in FIG. 1B, the first mating member is a locating pin 72, and the second mating member is a locating hole 74.

Other alignment mechanisms known to those skilled in the art may be utilized with the present invention; the invention is not limited to the embodiments disclosed. The attachment of the chute 20 to the carriage 15 is described more fully in the above-referenced co-pending application Ser. No. 09/303,257.

Considering now the latching mechanism 53 in greater detail with reference to FIGS. 1A, 1B, and 4, a shaft 55 is rotatably mounted to the chute 20. The shaft 55 passes through at least two openings 57 in the chute 20 which are aligned and sized to allow rotation of the shaft 55. A latching fastener is attached to the shaft 55 and engages a mating element on the carriage 15. The latching fastener is preferentially a cam latch 67 attached proximate one end of the shaft 55, and the mating element is preferentially a latch pin 69 attached to the carriage 15. An actuating handle 65 is attached at the other end of the shaft 55 and is accessible by reaching into the enclosure 12 through the opening 30 when the chute 20 is in the printing position 2. When the handle 65 is rotated by a user, the cam latch 67 attached at the other end of the shaft 55 is similarly rotated. The cam latch 67 is adapted to engage the latch pin 69, which is attached to the carriage 15 in a location such that when the latch 67 and the pin 69 are fully engaged the chute 20 is maintained in the printing position 2 as shown in FIG. 1A.

A stop arrangement limits the rotation of the shaft. A preferred embodiment of the stop arrangement is a stop pin 66 attached to the chute 20 which engages the handle 65 as it is rotated. An alternate embodiment of the stop arrangement is the depth of the slot in the cam latch 67 which engages the latch pin 69.

The cam latch 67 operates to prevent displacement of the chute 20 from the carriage 15 as the carriage 15 moves along the carriage axis 17 and sweeps each cartridge 22 in the chute 20 across the media 6 so that the ink can be deposited in the appropriate position on the media 6 during printing. When the latch 67 is disengaged from the pin 69, the handle 65 functions as a lever to allow the user to transmit the force necessary to move the chute 20 from the printing position 2 to the service position 4 of FIG. 1B–1C and vice-versa.

Considering now the chute 20 in further detail, the chute has a plurality of walls 75 which define one or more receiving spaces or stalls 19 for removably receiving the print cartridge 22. At least a part of one of the walls 75 is dimensioned smaller than the print cartridge 22 so that the print cartridge 22 can be grasped by the user when installed in the chute 20. A top opening indicated generally at 23 in the stall 19 is oriented such that the cartridge 22 is installed down into the opening 23 from the top, with the printhead 25 located at the bottom of the stall 19. A bottom opening (not shown) in the bottom of the stall 19 allows the printhead 25 to be located in the proper orientation to, and height above, the print media 6.

Figure 5:
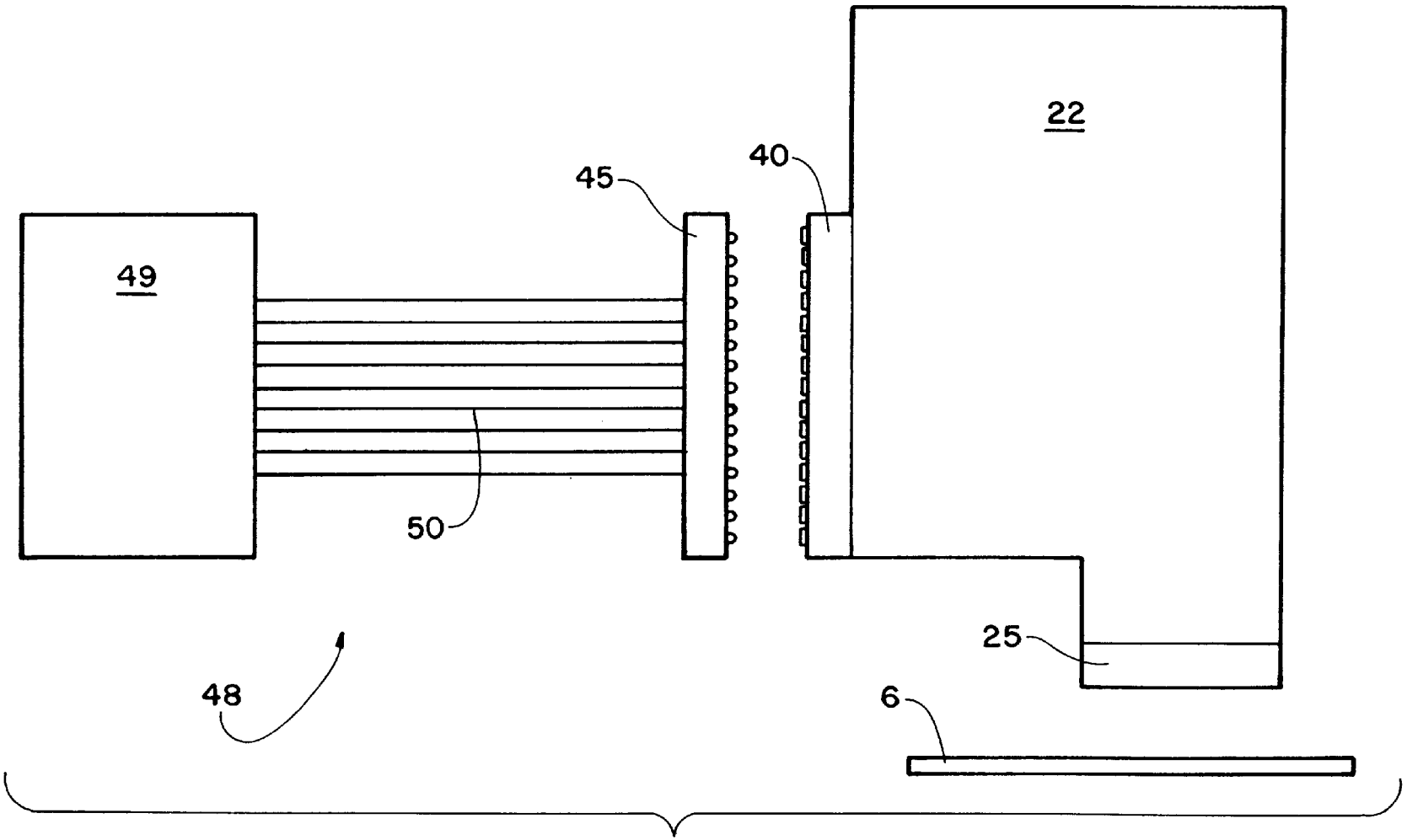
FIG. 5 is a schematic representation of the drive electronics of an inkjet printer usable with the present invention.

Considering now the drive electronics 48 in greater detail with reference to FIG. 5, the drive electronics 48 generally include print controller electronics 49 which control the ejection of ink onto the print media 6 by sending appropriate control signals to the printhead 25 located in the print cartridge 22. A flexible circuit 50 is connected between the print controller electronics 49 and a plurality of controller interconnects 45 mounted on the carriage 15. Each individual controller interconnect 45 is preferably a conductive bump, as described in further detail in the above-referenced U.S. Pat. No. 5,408,746. Each of the controller interconnects 45 mates with a corresponding one of a plurality of printhead interconnects 40 mounted on each cartridges 22 installed in the stall 19. Each individual printhead interconnect 40 is preferably an electrical contact pad mounted to the surface of the cartridge 22, as described in the above-referenced U.S. Pat. No. 5,408,746. The electrical connection to each cartridge 22 is formed by making a forcible mechanical connection between the printhead interconnects 40 and the controller interconnects 45 associated with the chute stall 19 in which the cartridge 22 is installed. The control signals sent by the print controller electronics 49 to the print cartridge 22 through the printhead interconnects 40 control the emission of ink from the printhead 25. Inkjet printer drive electronics 48 are well known to those skilled in the art and can assume different functional and mechanical aspects. Since such electronics are well known to those skilled in the art, they will not be described hereinafter in greater detail.

Considering now the carriage 15 in further detail as shown in FIG. 1B, controller interconnects 45 are mounted on the carriage 15 in a location such that, when the chute 20 is engaged with the carriage 15 in the printing position 2 as in FIG. 1A, the controller interconnects 45 are engaged with the printhead interconnects 40 of the cartridges 22 installed in the stall 19 and electrical contact between the printhead 25 and the printer control electronics is established. Conversely, when the chute 20 is disengaged from the carriage 15 and moved to the service position 4, the printhead interconnects 40 are electrically disconnected from the controller interconnects 45. As shown in FIG. 1B, each stall 19 has a first opening 80 located adjacent to the position of the controller interconnects 45 when in the printing position 2. The first opening 80 is also adjacent to the location of the printhead interconnects 40 when a cartridge 22 is installed in the stall 19. When the chute 20 is moved to the printing position 2, the printhead interconnects 40 of an installed cartridge 22 mate with the controller interconnects 45 on the carriage 15 through the first opening 80 in the stall 19. In the preferred embodiment, the controller interconnects 45 are offset from the surface of the carriage 15 at a spacing sufficient for them to protrude through the first opening 80 and into the stall 19 when the chute 20 is in the printing position 2, in order for the controller interconnects 45 to contact the printhead interconnects 40.

Considering now a complementary aspect of the chute 20 associated with exerting a biasing force sufficient to maintain good electrical contact between the printhead interconnects 40 and the controller interconnects 45, each stall 19 also has a region indicated generally at 83 at which the biasing force is applied. This region 83 is spaced apart from the first opening 80 at the opposite end of the stall 19. When a cartridge 22 is inserted in a stall 19, the body of the cartridge 22 is positioned between the first opening 80 and region 83. The region 83 is located adjacent to the shaft 55, and is generally bisected by the shaft 55 in the preferred embodiment. A preload cam 84 is eccentrically disposed around the shaft 55 at a position adjacent the region 83. For a chute 20 with multiple stalls 19, each stall has a corresponding preload cam 84.

In the preferred embodiment, a second opening 82 in each stall 19 occupies the region 83. The second opening 82 is sized and positioned relative to the preload cam 84 such that when the shaft 55 is rotated the preload cam 84 can rotate through the second opening 82 and contact the cartridge 22. In an alternate embodiment, the chute 20 in the region 83 at which the biasing force is applied has no second opening but rather the chute 20 made of a pliable material rather than a rigid one. When the preload cam 84 is rotated to contact the pliable portion of the stall the material is deflected to contact the cartridge 22.

The eccentricity of the preload cam 84 is such that, when the shaft 55 is further rotated after the cam latch 67 has begun to engage the pin 69 to maintain the chute in the printing position 2, the preload cam 84 exerts sufficient biasing force on the cartridge 22 (through the second opening 82, or indirectly via the pliable material) so as to create and maintain good electrical contact between the printhead interconnects 40 and the controller interconnects 45 while the chute 20 is in the printing position 2.

Cartridges 22 may be installed in the stalls 19 when the chute 20 is located in the service position 4. The cartridge 22 is loosely inserted into the stall 19; the application of a substantial force by the user to insert the cartridge 22 in the stall 19 is not required because neither precise mechanical alignment of the cartridge 22 nor electrical contact of the cartridge 22 with the drive electronics 48 are established during cartridge insertion. One or more preload springs 86 attached to a wall of the stall 19 and preferentially having a cantilevered leaf design initially align the cartridge 22 in an approximate position when inserted. The handle 65 can be used to move the chute 20 toward the printing position 2, and engage the cam latch 67 with the pin 69.

Figure 6:
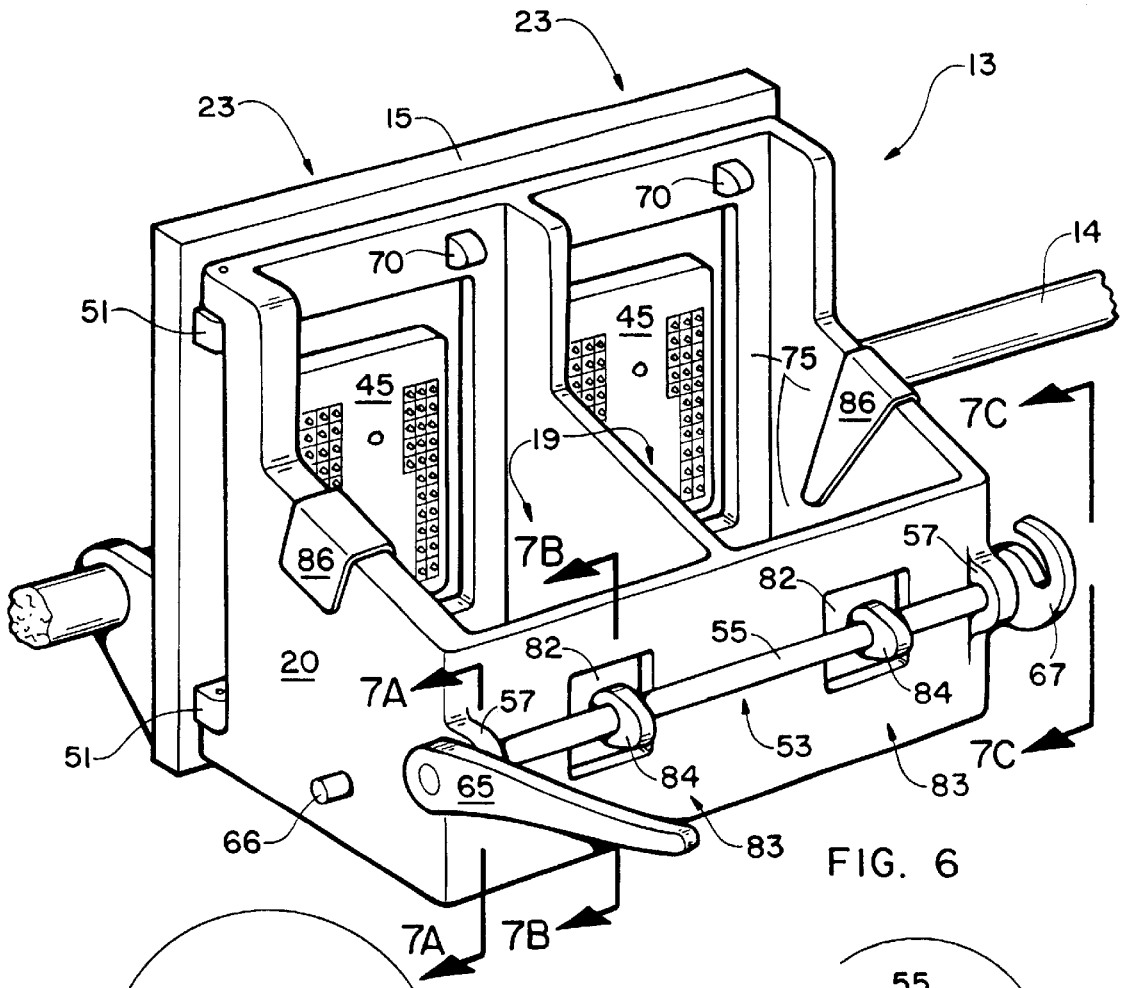
FIG. 6 is a perspective view of the cartridge chute of FIGS. 1A–1B useful for illustrating the operation of the latching mechanism.

Once the cam latch 67 and pin 69 have been engaged, the shaft 55 is further rotated to latch the chute 20 to the carriage 15 in the printing position 2. As described in further detail hereinafter, the biasing force is applied to the cartridge 22 by each preload cam 84 during further shaft 55 rotation. The biasing force directs the cartridge 22 into engagement with a guide arrangement on the chute 20 that properly aligns the cartridge 22 in the stall 19. The embodiment of the guide arrangement shown in FIGS. 1A, 1B, and 6 includes a guide projection 70 in each stall 19. A rounded upper front edge indicated generally at 24 of the cartridge 22 is urged against the lower surface of the guide projection 70 by the biasing force, thus exerting a downward force on the cartridge 22. Other mechanisms known in the art which are capable of exerting downward force on the cartridge 22 when the chute 20 is latched to the carriage 15 are usable with the present invention.

The guide arrangement further includes alignment elements (not shown) which contact the one or more datums 27 on the cartridge 22 as the chute 20 is moved to the printing position 2. The alignment elements properly align the controller interconnects 45 with the printhead interconnects 40, and properly align the printhead 25 relative to the print media 6. Exemplary configurations of alignment elements usable with the present invention are described in the above-referenced U.S. Pat. Nos. 5,408,746 and 5,646,665. The alignment elements may be mounted within the stall 19 or elsewhere on the chute 20, or may be mounted on the carriage 15 and protrude into the receiving space of the chute 20 through the first opening 80.

Considering now in greater detail the operation of the latching mechanism 53 shown in FIG. 6, FIGS. 7–10 illustrate how the handle 65, cam latch 67, latch pin 69, stop pin 66, and one or more preload cams 84 interoperate to make electrical connection between the printer interconnects 40 on the one or more cartridges 22 and the controller interconnects 45 on the carriage 15, and to engage and maintain the chute 20 in the printing position 2, as the latching mechanism 53 moves from the open position to the closed position.

Figure 7A:
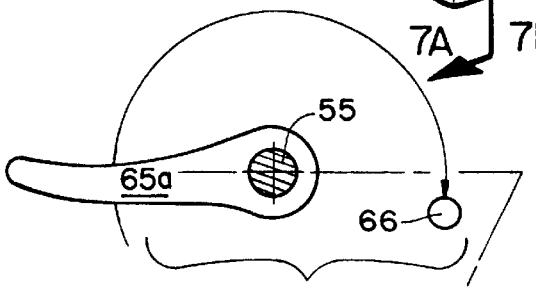
FIGS. 7A–7C show three views of the latching mechanism of FIG. 6 in the open position: a cross-sectional view of the handle and stop pin (FIG. 7A); a cross-sectional view of the preload cam, print cartridge, and electrical interconnects (FIG. 7B); and an end view of the cam latch and pin (FIG. 7C).
Figure 7C:
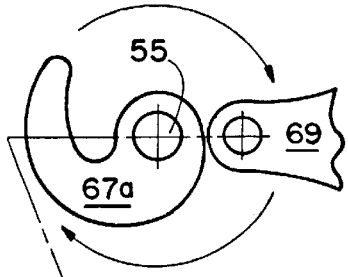
Figure 7B:
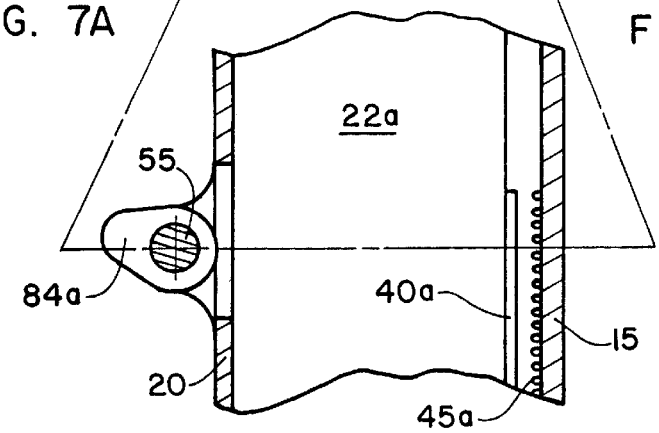

FIGS. 7A–7C show the latching mechanism 53 in the open position. The cam latch 67*a* is disengaged from the latch pin 69, and therefore the chute 20 can be displaced from its illustrated position adjacent to the carriage 15 if desired. The handle 65*a* is unfolded out from the side of the chute 20 and extends radially from the carriage axis 17 further than does shaft 55. In this position, the handle 65*a* can be operated as a lever to move the chute 20 between the printing position 2 and the service position 4. In the unlatched position, preload cam 84*a* does not engage cartridge 22*a*. The printer interconnects 40*a* and the controller interconnects 45*a* are not in electrical contact.

FIGS. 8A–8C show the latching mechanism 53 after clockwise rotation from the position shown in FIGS. 7A–7C to a position where the cam latch 67*b* is at a point of initial engagement with the latch pin 69. The engagement of the latch 67*b* with pin 69 engages the chute 20 with the carriage 15. The handle 65*b* and the preload cam 84*b* mounted to the shaft 55 have been rotated by the same angular displacement as the latch 67*b*. However, preload cam 84*b* does not engage cartridge 22*b* in this position, and thus the printer interconnects 40*b* and the controller interconnects 45*b* are not in electrical contact.

FIGS. 9A–9C show the latching mechanism 53 after further clockwise rotation from the positions shown in FIGS. 8A–8C to a position where the cam latch 67*c* is at a point of further engagement with the latch pin 69 and where the preload cam 84*c* exerts maximum biasing force on the cartridge 22*c*. The handle 65*c* and the preload cam 84*c* mounted to the shaft 55 have been rotated by the same angular displacement as the latch 67*c*. In this position, preload cam 84*c* has engaged cartridge 22*c*, and the eccentricity of preload cam 84*c* with respect to the shaft 55 is oriented such that cartridge 22*c* is displaced towards the carriage 15 by the biasing force. The biasing force makes good electrical connection between the printer interconnects 40*c* and the controller interconnects 45*c*.

FIGS. 10A–10C show the latching mechanism 53 in the closed position. The cam latch 67*d* is at the point of full engagement with the latch pin 69*d*. In this position, preload cam 84*d* has rotated slightly past the point of exerting maximum biasing force of cartridge 22*d*. As a result, somewhat less biasing force is applied than in FIGS. 8A–8C; however, this force is sufficient to maintain good electrical connection between the printer interconnects 40*d* and the controller interconnects 45*d*. In this position, the handle 65*d* is in contact with the stop pin 66, which prevents further clockwise rotation of the handle 65*d*. The over-rotation of the preload cam 84*d* past the point of maximum biasing force also inhibits counterclockwise rotation of the handle 65*d* unless counterclockwise force is applied to the handle by the operator. The handle 65*d* is folded in towards the side of the chute 20 and does not protrude radially from the carriage axis 17 any further than the chute 20; therefore, the handle 65*d* does not add to the open space required within the printer enclosure for the carriage 15 as it sweeps along the carriage axis 17 during printing.

Figure 11A:
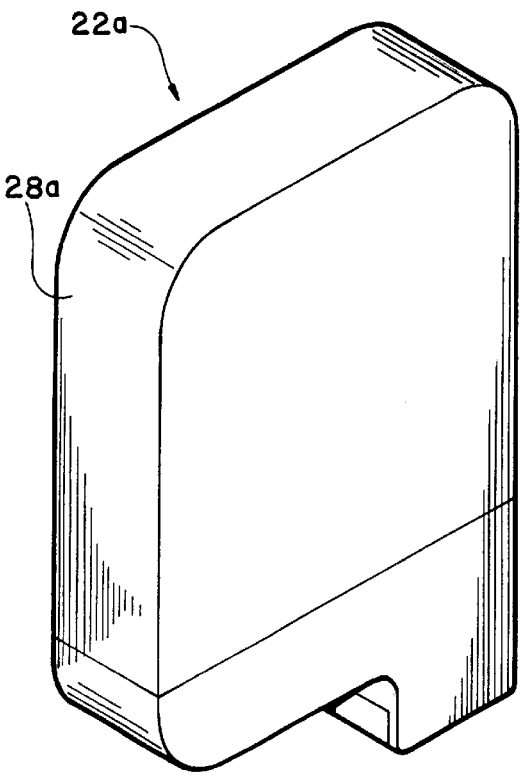
FIG. 11A PRIOR ART
FIGS. 11A–11D are schematic representations of prior art printhead and print reservoir configurations usable in a printer embodying the present invention.
Figure 11B:
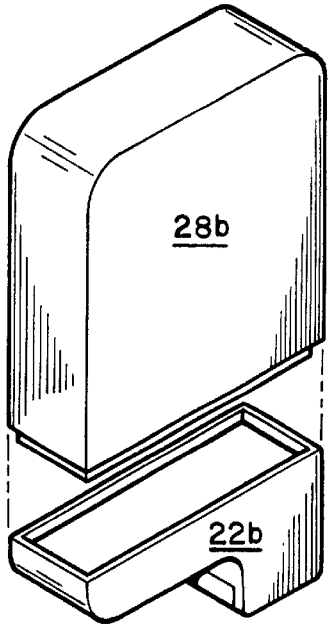
FIG. 11B PRIOR ART
Figure 11C:
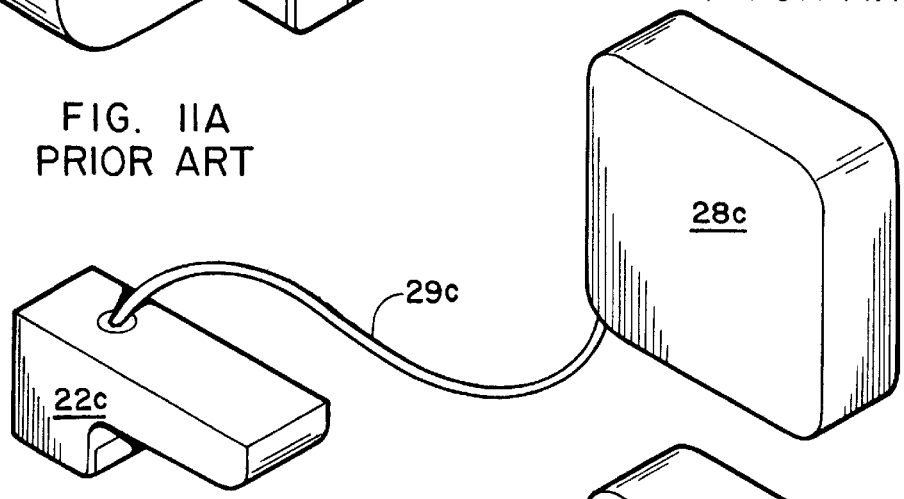
FIG. 11C PRIOR ART
Figure 11D:
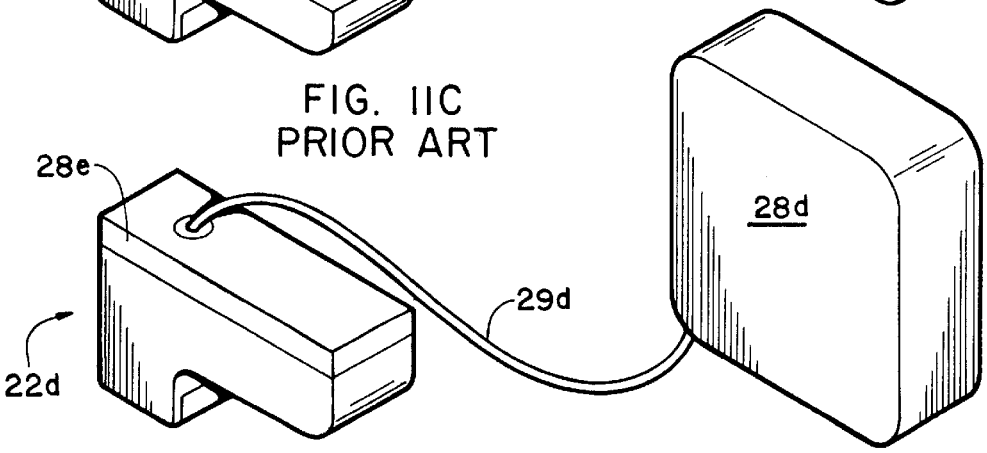
FIG. 11D PRIOR ART

A number of alternative cartridge configurations and ink delivery systems usable with the present invention are known to those skilled in the art. In a preferred embodiment, the chute holds two cartridges, one for black, and the other a tri-color cartridge having three separate ink reservoirs for cyan, magenta, and yellow. An alternate embodiment has four receiving spaces to hold four cartridges, each printing a different color such as black, cyan, magenta, and yellow. Yet another embodiment holds only a single black cartridge. As shown schematically in FIGS. 11A through 11D, the ink may be supplied to the printhead in different ways. In FIG. 11A, an ink reservoir 28*a* is located within the print cartridge 22*a*. In FIG. 11B, an ink reservoir 28*b* is detachable from the print cartridge 22*b*, but the reservoir 28*b* is attached to the print cartridge 22*b* when they are installed in the chute 20. In FIG. 11C, the print cartridge 22*c* does not contain an ink reservoir; ink is supplied to the cartridge 22*c* instead from an off-chute ink reservoir 28*c* via a tube 29*c*. In FIG. 11D, the main ink reservoir 28*d* is similarly located off-chute and connected to the print cartridge 22*d* via a tube 29*d*, but the print cartridge 22*d* also contains an auxiliary reservoir 28*e*. The present invention may be utilized with any of the abovementioned cartridge configurations and ink delivery systems, and with other design alternatives in which the printhead 25 and the print media 6 are in relative motion to each other.

From the foregoing it will be appreciated that the print cartridge latching mechanism for a displaceable print cartridge chute provided by the present invention represents a significant advance in the art. An inkjet printer can be constructed according to the present invention so as to provide access to the print cartridges through a side of the printer rather than through the top. Such a printer can advantageously be stacked with or below other electronics equipment to minimize footprint or floor space.

Although several specific embodiments of the invention have been described and illustrated, the invention is not to be limited to the specific methods, forms, or arrangements of parts so described and illustrated. The invention is limited only by the claims.

What is claimed is:

1. An inkjet printer for ejecting ink from at least one print cartridge onto a print medium sheet, comprising:

a stackable enclosure having a top planar surface and a plurality of vertical wall members, one of said plurality of vertical wall members including a passageway to provide access to an interior portion of the enclosure;

a carriage unit mounted for rectilinear movement within the enclosure to facilitate transporting the at least one print cartridge toward and away from the passageway;

a print cartridge chute attached to the carriage unit and movable between a printing position to facilitate the ejecting of ink from the at least one print cartridge onto the print medium sheet and a service position to facilitate removal and replacement of the at least one print cartridge; and a latching mechanism mounted to the chute for latching the carriage and the chute together to secure them in the printing position, the latching mechanism disengagable from the carriage to facilitate the movement of the chute into the service position.

2. The inkjet printer of claim 1, further comprising:

controller electrical interconnects attached to the carriage;

a receiving space in the chute for removably receiving the print cartridge loosely inserted;

a first opening in the chute adjacent the controller electrical interconnects; and a preload cam mounted to the latching mechanism and spaced apart from the first opening at the opposite end of the receiving space, the preload cam rotatable to apply a biasing force to the print cartridge so as to urge printhead controller electrical interconnects on the print cartridge into engagement with the interconnect electronics.

3. The inkjet printer of claim 2, wherein the preload cam exerts a biasing force on the print cartridge to maintain engagement between the printhead electrical interconnects and the controller electrical interconnects.

4. The inkjet printer of claim 3, wherein the latching mechanism engages the carriage before the preload cam contacts the print cartridge.

5. The inkjet printer of claim 3, the latching mechanism further comprising:

a cam shaft on which the preload cam is eccentrically attached;

a cam latch at one end of the shaft for engaging the carriage; and an actuating handle at another end of the shaft, the actuating handle having an open position for opening the latch and a closed position for closing the latch, wherein the preload cam is rotationally positioned on the cam shaft such that moving the actuating handle from the open position to the closed position rotates the preload cam to a position just past the point where the preload cam exerts maximum biasing force on the print cartridge.

6. The inkjet printer of claim 5, further comprising:

a stop attached to the chute and contacting the handle to prevent the shaft from rotating excessively past the point where the preload cam exerts maximum biasing force on the print cartridge.

7. The inkjet printer of claim 5, wherein the carriage is movable along a carriage axis, and wherein the actuating handle when in the closed position is located such that the actuating handle does not radially protrude any further from the carriage axis than the chute.

8. The inkjet printer of claim 5, wherein the chute further removably receives a plurality of print cartridges, further comprising a corresponding plurality of preload cams rotationally positioned on the cam shaft for contacting each of the plurality of print cartridges.

9. The inkjet printer of claim 2, further comprising:

a guide arrangement in the receiving space for directing the print cartridge into proper alignment in the printing position, the preload cam urging the print cartridge into engagement with the guide arrangement as the latching mechanism is operated.

10. The inkjet printer of claim 9, wherein the guide arrangement is mounted on the chute.

11. The inkjet printer of claim 9, wherein the guide arrangement is mounted on the carriage and protrudes into the receiving space.

12. The inkjet printer of claim 9, wherein the guide arrangement includes a guide projection disposed in the receiving space for engaging a surface of the print cartridge so as to exert a downward force on the print cartridge as the latching mechanism is closed.

13. The inkjet printer of claim 9, wherein the guide arrangement includes a preload spring attached to a wall of the receiving space for urging the print cartridge into an approximate position during print cartridge installation.

14. The inkjet printer of claim 2, further comprising:

a second opening in the chute adjacent the preload cam, the second opening sized to allow the preload cam to contact and apply the biasing force to the print cartridge through the second opening as the latching mechanism is operated.

15. The inkjet printer of claim 2, further comprising:

a pliable region in the chute adjacent the preload cam, the pliable region deflectable when contacted by the preload cam during operation of the latching mechanism so as to contact and apply the biasing force to the print cartridge.

16. The inkjet printer of claim 1, wherein the latching mechanism further comprises:

a cam shaft;

a cam latch at one end of the shaft for engaging the carriage; and an actuating handle at another end of the shaft, the actuating handle for opening and closing the latch and for moving the chute.

17. The inkjet printer of claim 1, the chute further comprising:

a plurality of walls defining a receiving space in the chute for removably receiving the print cartridge through an opening, at least one of the walls adjacent the opening being dimensioned smaller than the print cartridge such that the print cartridge can be grasped when installed in the chute.

18. A method for installing a print cartridge in an inkjet printer, comprising:

moving a chute for removably receiving the print cartridge to a service position displaced from a printing position;

inserting the print cartridge into the chute in the service position;

moving the chute into proximity with a carriage for transporting the print cartridge along a carriage axis during printing such that a latch on the chute is aligned with a mating latch member on the carriage; and latching the chute to the carriage so as to locate the chute in a printing position.

19. The method of claim 18, further comprising:

unlatching the chute from the carriage; and removing the print cartridge from the chute in the service position.

20. The method of claim 18, wherein the carriage has controller electrical interconnects for mating with printhead electrical interconnects on the print cartridge, and wherein the print cartridge is loosely installed in the chute during the inserting step, further comprising:

applying a biasing force to the print cartridge so as to make electrical connection between the controller electrical interconnects and the printhead electrical interconnects.

21. An inkjet printer having a print cartridge for applying an ink to a media, comprising:

a carriage;

a chute mounted on the carriage for removably receiving the print cartridge, the chute movable between a printing position relative to the media and a service position displaced from the printing position; and a latching mechanism on the chute for engaging the carriage to hold the chute in the printing position, the latching mechanism disengagable from the carriage to allow the chute to move to the service position to install or remove the print cartridge from the chute.

* * * * *